United States Patent [19]

Bailey et al.

[11] Patent Number: 5,009,265

[45] Date of Patent: Apr. 23, 1991

[54] PACKER FOR WELLHEAD REPAIR UNIT

[75] Inventors: Thomas F. Bailey, Houston; Charles E. Lancaster, Iola; Richard Lee, The Woodlands, all of Tex.

[73] Assignee: Drilex Systems, Inc., Houston, Tex.

[21] Appl. No.: 404,159

[22] Filed: Sep. 7, 1989

[51] Int. Cl.[5] ..... E21B 23/06; E21B 33/12

[52] U.S. Cl. ..... 166/118; 166/123; 166/125

[58] Field of Search ..... 166/118, 123, 125, 131, 166/133, 138, 140

[56] References Cited

U.S. PATENT DOCUMENTS

| | | | |
|---|---|---|---|
| Re. 22,180 | 9/1942 | Otis . | |
| 1,842,116 | 1/1932 | Rasmussen | 166/120 |
| 2,117,535 | 5/1938 | Baker et al. . | |
| 2,893,492 | 7/1959 | Brown | 166/119 |
| 2,989,122 | 6/1961 | Kenneday | 166/138 |
| 3,102,594 | 9/1963 | Crowe | 166/125 |
| 3,279,542 | 10/1966 | Brown | 166/130 |
| 3,470,951 | 10/1969 | McGill | 166/123 |
| 3,495,659 | 2/1970 | McGill | 166/125 |
| 3,678,998 | 7/1972 | Cockrell et al. | 166/123 |
| 4,273,372 | 6/1981 | Sheshtawy | 294/86.15 |
| 4,432,418 | 2/1984 | Mayland | 166/123 |
| 4,436,150 | 3/1984 | Barker | 166/123 |
| 4,452,304 | 6/1984 | Barrier et al. | 166/70 |

*Primary Examiner*—Bruce M. Kisliuk

*Attorney, Agent, or Firm*—Edgar A. Zarins; Malcolm L. Sutherland

[57] ABSTRACT

A geothermal wellhead repair unit including a mechanically set packer to isolate the wellhead for removal and repair thereof. The packer is run into the well string using a running tool. The packer is set by placing tension on the mandrel to set the packing elements and the slip assembly. Once the packer is set, the running tool can be disengaged without fear of collapsing the packer and the wellhead removed for repair or replacement. Upon replacement of the wellhead, the running tool is used to unset and retrieve the packer.

24 Claims, 5 Drawing Sheets

Fig-1
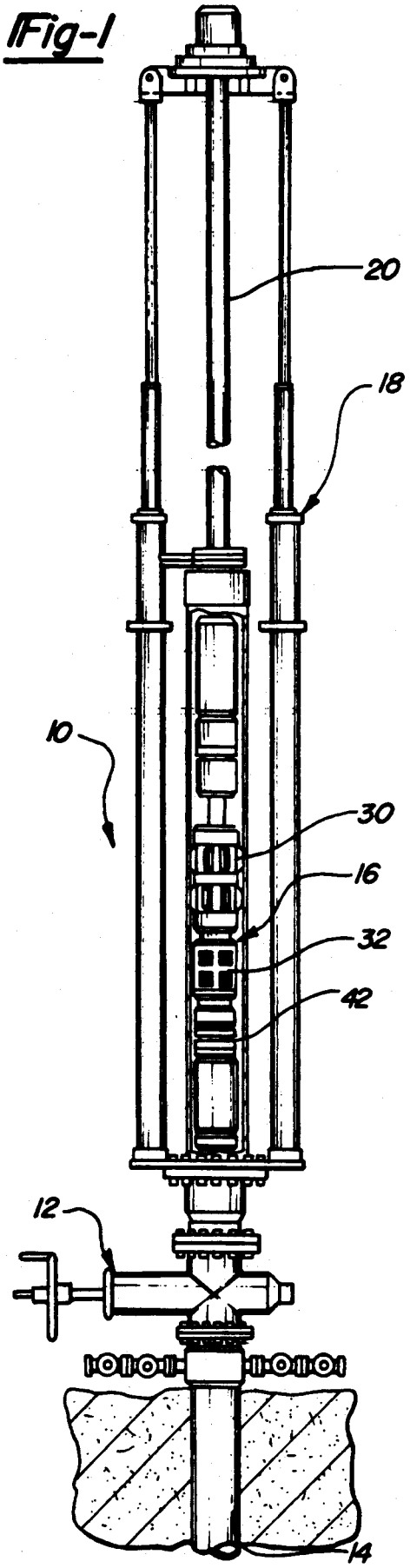
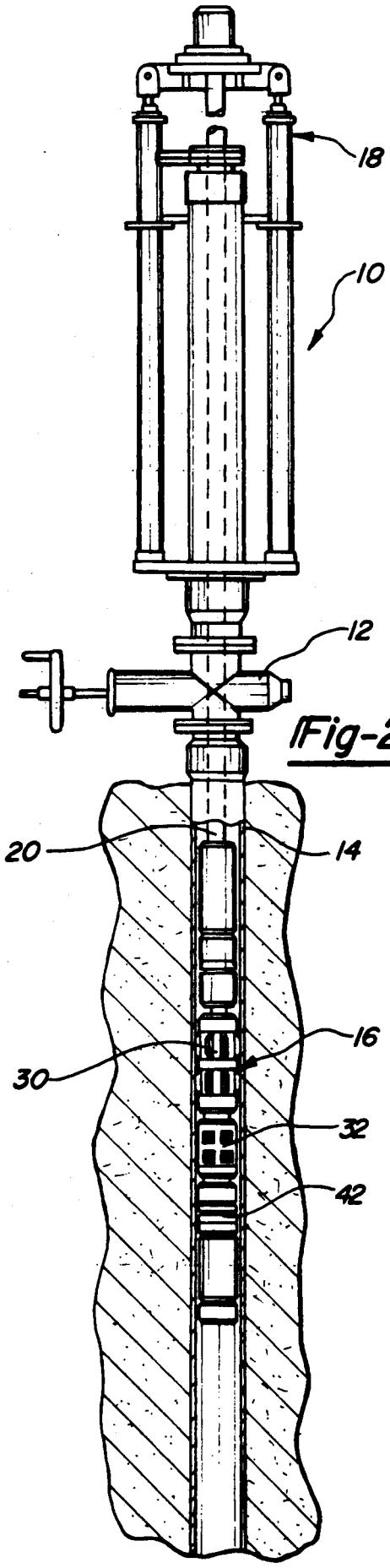
Fig-2

20
106
28
104
102
98
100
96
88
90
94
92
24
22
26
30
33
32
36
34
38
40
48
42
16
46
44
44
50
52
24
54
78
58
60
66
74
56
68
14
62
84
76
64
72
70
82
80
86

20
14
28
106
104
98
96
100
94
88
94
92
16
24
22
30
32
26
36
34
38
33
16
40
48
42
44
44
46
50
54
78
52
76
58
60
66
74
56
68
84
70
64
72
82
80
86

PACKER FOR WELLHEAD REPAIR UNIT

BACKGROUND OF THE INVENTION

I. Field of the Invention

This invention relates to a unit for isolating a wellhead for removal and repair of the wellhead and, in particular, to a packer for a wellhead repair unit which securely packs off the well to permit safe removal of the wellhead and which subsequently can be retrieved mechanically to allow continued production.

II. Description of the Prior Art

Various devices have been developed to isolate a well for removal and repair of the wellhead in a geothermal well. The extreme temperatures and pressures found in geothermal wells makes it important to safely seal off the well prior to removal of the wellhead. The prior known repair systems utilize a hydraulically set packer which is dependent upon the pressure balance between the downhole pressure and the hydraulic pressure applied through the running tool from the surface. Some tools include means for increasing the gripping action within the casing in the event downhole pressure increases. To release the packer once the repairs are completed and the wellhead is replaced, the hydraulic pressure is increased to overcome the downhole pressure.

Because the past known repair units are dependent upon a critical pressure balance, variations in the downhole pressure can cause release and travel of the packer or in the extreme case a blowout of the tool. Pressure variations may also cause the hydraulically set packer to slip down into the casing. As a result, because the retrieval tool has limited downhole reach, re-engagement may not be possible requiring other fishing techniques or lost production. Alternatively, an increase in downhole pressure can cause the packer to form a harder grip with the casing wall requiring an increased hydraulic pressure to release the packer.

Other packers are well known for a variety of applications. However, not all packers are suitable for the environment of a geothermal well. Moreover, many packers are not retrievable and are merely drilled out when further work is needed on the well. These are not suitable alternatives for a completed and operated geothermal well.

SUMMARY OF THE PRESENT INVENTION

This invention overcomes the disadvantages of the prior known geothermal wellhead repair units by providing a mechanically set and released packer for the repair unit which securely packs-off the geothermal well to facilitate removal and repair of the wellhead.

The geothermal wellhead repair unit of the present invention generally comprises a hydraulic extension assembly attachable to the top flange of the wellhead valve, a running tool extending through an upper seal assembly and connected to a well packer. The hydraulic extension assembly includes hydraulic cylinders for the controlled insertion and retraction of the running tool and packer to the desired position within the casing. The packer includes a plurality of packing elements separated by packing spacers, a slip assembly for selective engagement with the casing wall, and a set of, drag blocks to facilitate setting of the tool. The setting assemblies are disposed within an outer sleeve concentrically mounted to an inner mandrel having a pressure equalizing passageway formed therein. A J-slot connector is used at the upper end to facilitate disconnection and connection of the running string from the packer. The lower end of the packing tool includes a ratchet thread assembly which controls the selective setting and release of the packer and connects the outer sleeve assembly to the inner mandrel. The packer is provided with at least two means for release to ensure retrieval of the tool for further production.

The packer is set through mechanical longitudinal movement of the mandrel relative to the outer sleeve assembly. As the tool is run into the hole, the frictional engagement of the drag blocks with the casing will cause the tool to be pre-loaded as a bottom ratchet nut engages a ratchet sleeve. Once the packer is positioned, the mandrel is drawn upwardly against the friction of the drag blocks causing the slip assembly and packing elements to be set against the casing. With the packer set in the casing, the running tool can be disconnected through disconnection of the release/tie back sleeve from the upper end of the packer which will also cause the pressure equalizing passageway to be closed. With the required repairs completed, the release/tie back sleeve is reconnected to the packer thereby opening the equalizing passageway. The primary and preferred method of releasing the packer is by rotating the mandrel relative to the outer sleeve assembly to threadably disconnect the ratchet nut from the ratchet sleeve resulting in release of the packer. Other methods of release involve shear pins and added longitudinal force to release the connection between the outer sleeve assembly and the mandrel. With the packer unset, the tool can be removed from the hole for further production.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing in which like reference characters refer to like parts throughout the views and in which:

FIG. 1 is a perspective view of a wellhead repair unit embodying, the retrievable packer of the present invention to a wellhead of a well bore;

FIG. 2 is a perspective view of the present invention with the packet being run into the well bore;

DETAILED DESCRIPTION OF A PREFERRED EMBODIMENT OF THE PRESENT INVENTION

Figure 3:
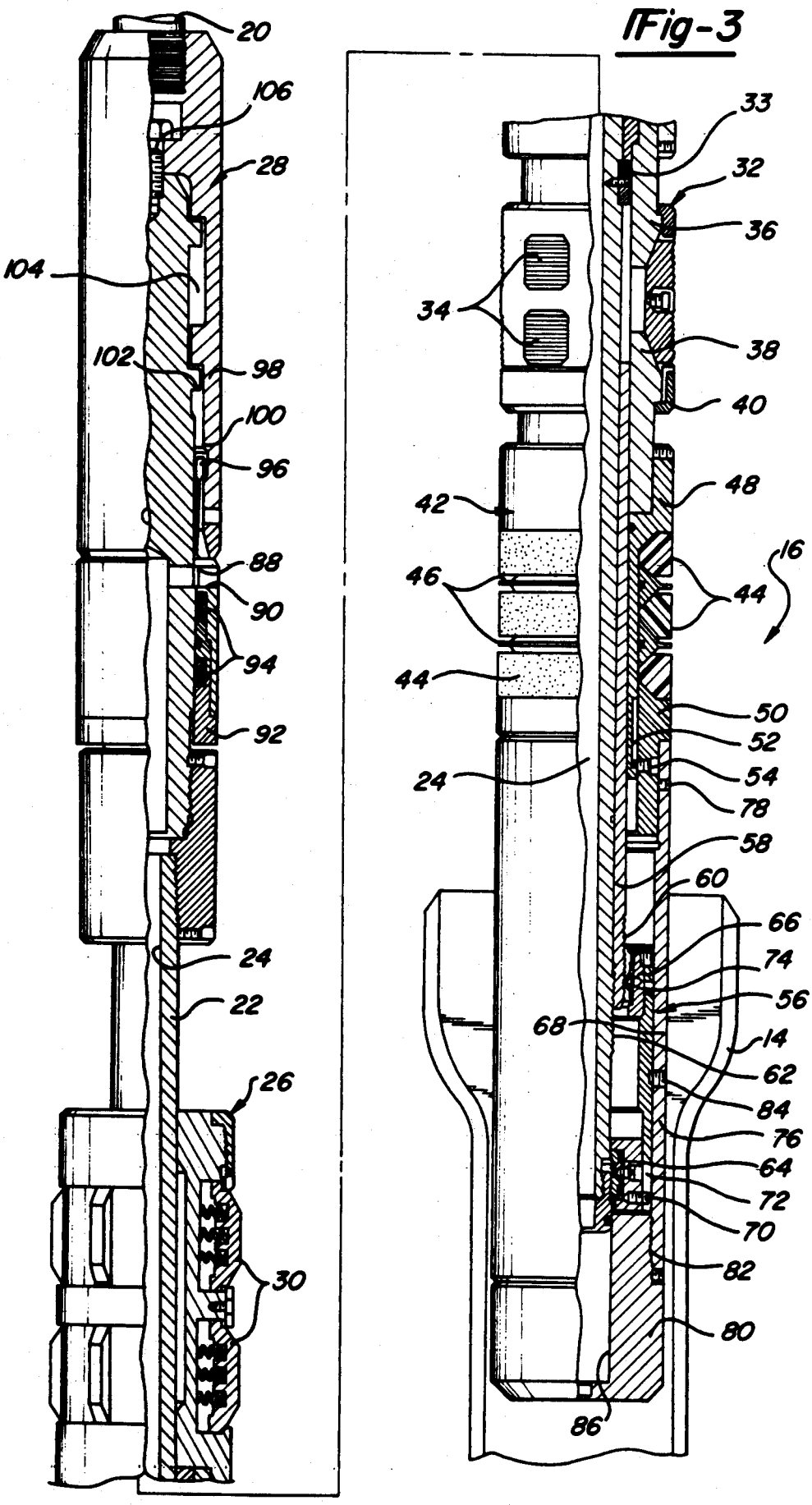
FIG. 3 is an enlarged perspective partially in cross-section of the packer prior to being run into the well bore.

Referring first to FIGS. 1 and 2, there is shown an apparatus 10 for isolating a wellhead 12 of a well bore 14 for removal and repair of the wellhead 12. The repair unit 10 includes a packer 16 embodying the present invention for packing off the well bore 14 to permit safe removal of the well head 12. The unit 10 is mountable to the wellhead 12 and includes a hydraulic extension assembly 18 which connects to a running string 20 detachably secured to the packer 16. The hydraulic extension assembly 18 controls the raising and lowering of the running string 20 in order to run and retrieve the packer 16 within the well bore 14. As will be subsequently described in greater detail, the packer 16 is run into the well bore 14 using the hydraulic extension assembly 18, mechanically set in the well 14, and detached from the running string 20 to allow removal and repair of the wellhead 12. Once repairs are completed, the unit 10 is again attached to the wellhead 12 and the running string 20 is lowered to retrieve the packer 16 for continued production. The packer 16 of the present invention allows mechanical setting and retrieval of the packer 16 while ensuring a secure pack-off of the well bore 4.

Figure 4:
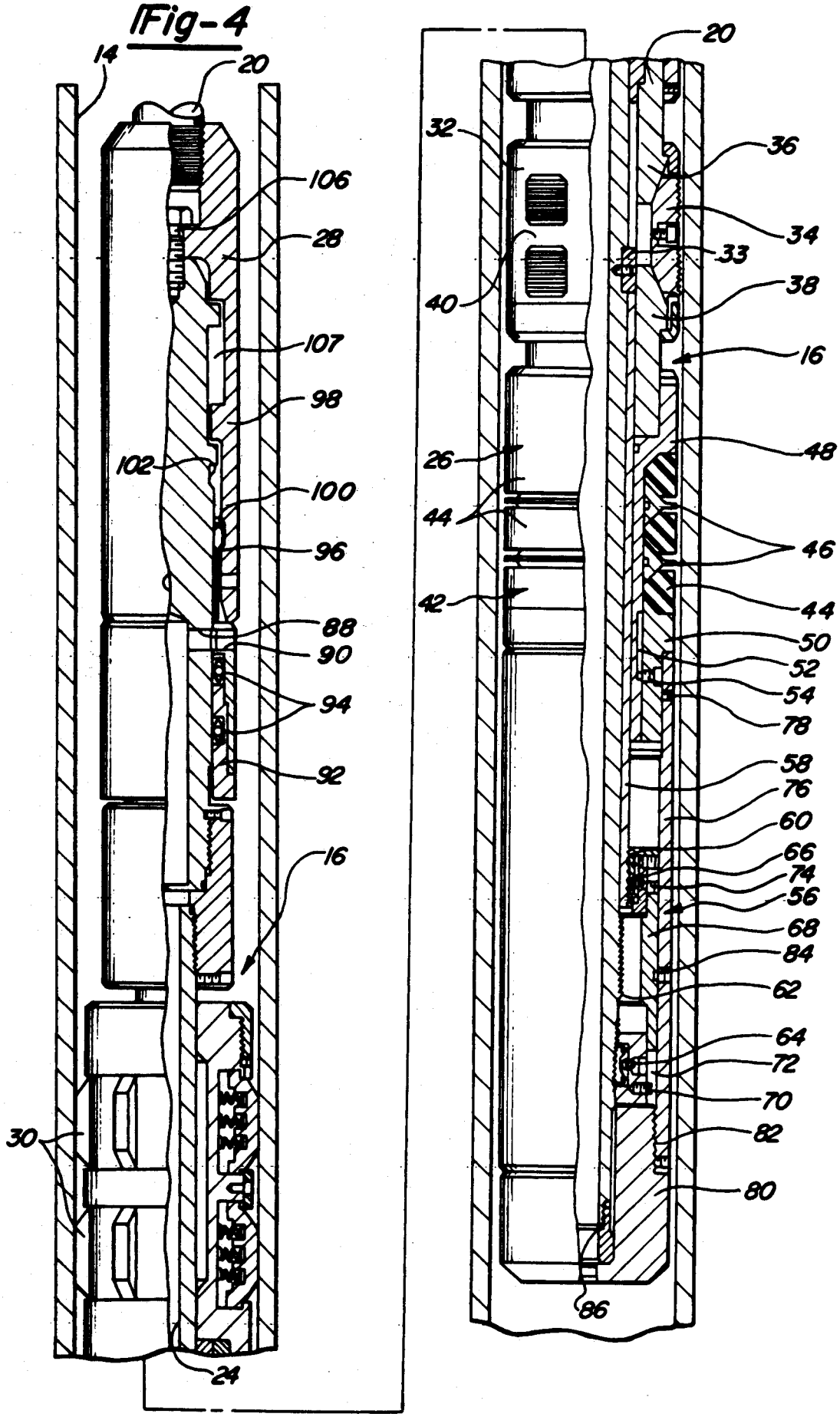
FIG. 4 is an enlarged perspective partially in cross-section the packer being run into the well bore.
Figure 5:
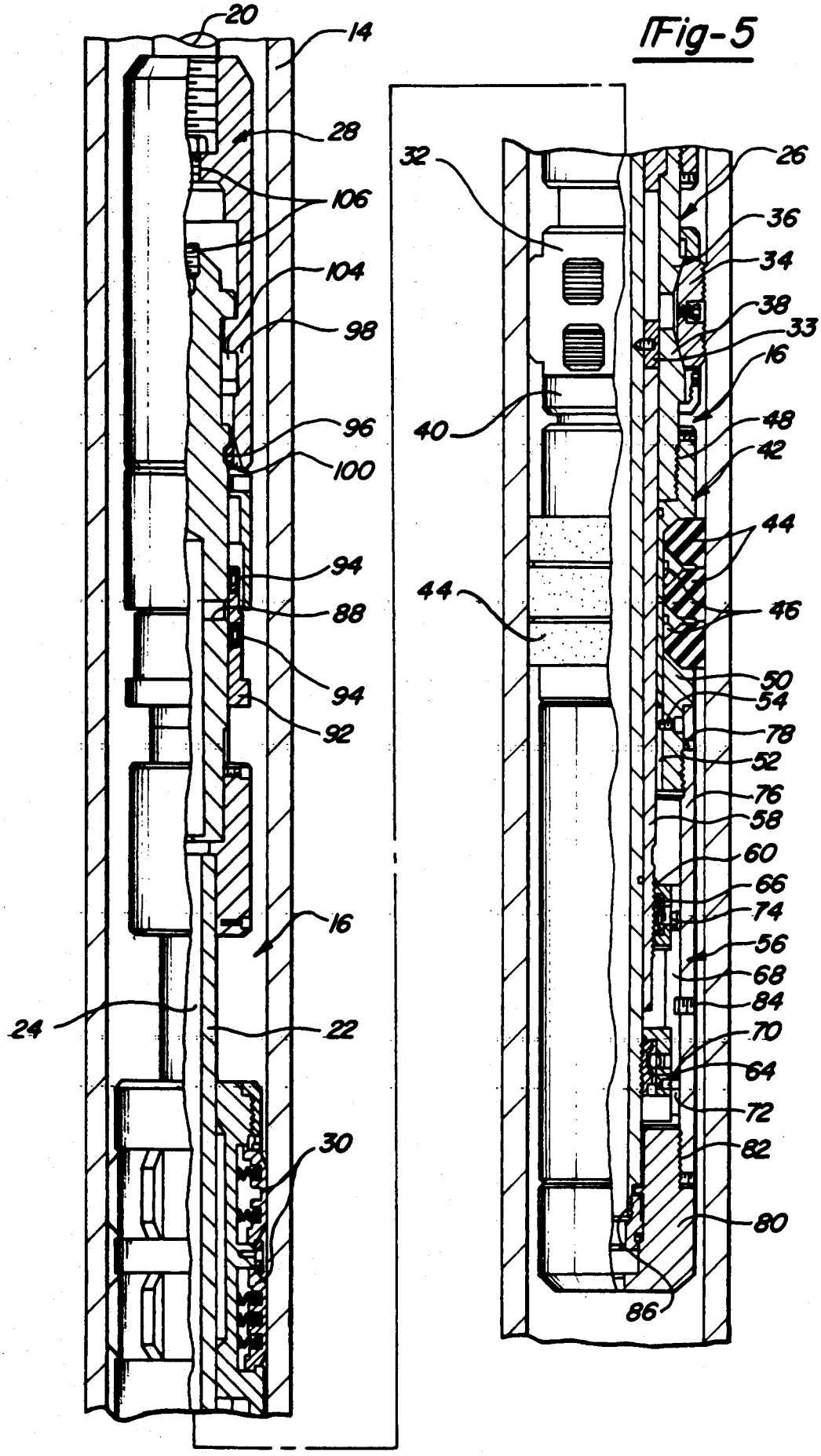
FIG. 5 is an enlarged perspective partially in cross-section the packer set in the well bore.

Referring now to FIGS. 3 through 5, FIG. 3 shows the packer 16 hanging freely prior to being run into the well bore 14, FIG. 4 shows the packer 16 as it is run into the well bore 14, and FIG. 5 shows the packer 16 set within the well bore 14. The packer 16 of the present invention generally comprises an inner mandrel 22 having a partial axial bore 24, outer sleeve assembly 26 which carries the setting components of the packer 16 and is longitudinally movable relative to the mandrel 22, and a connector assembly 28 which detachably connects the packer 16 to the running string 20. The packer 16 is mechanically set by applying tension to the mandrel 22 relative to the sleeve assembly 26 to set the components thereof and thereafter released by rotating the mandrel 22 relative to the sleeve assembly 26 as will be subsequently described. A secondary method of release can be accomplished by applying added tension to the mandrel 22 in the event rotation does not release the tool.

The outer sleeve assembly 26 includes a set of drag blocks 30 which are spring-biased outwardly to engage the casing wall 14 and provide an initial tension to the packer 16. Positioned within the sleeve assembly 26 just downhole the drag blocks 30 are slip assemblies 32 selectively engageable with the wall 14 as the packer 16 is set to securely position the packer 16. The slip assemblies 32 preferably include slip elements 34 which have wall engaging teeth and upper slip cone 36 and lower slip cone 38 to drive the slip elements 34 outwardly into engagement with the wall 14. The slip elements 34 are retained by slip body 40. The slip elements 34 are driven outwardly into engagement with the casing 14 as upper slip cone 36 and lower slip cone 38 are drawn together beneath the slip elements 34.

Spaced downhole of the slip assembly 32 is the sealing packer 42 comprising at least one packing element 44 selectively compressible into sealing engagement with the well bore 14. The packing elements 44 are spaced apart by spacer rings 46 and are seated between an upper packer sleeve 48 which extends beneath the packing elements 44 and spacer rings 46 to essentially carry the assembly and a lower packer collar 50. The packing elements 44 and spacer rings 46 are slidably and sealingly engage the packer sleeve 48 to facilitate packing compression. The elements 44 are compressed into sealing engagement as the collar 50 shifts relative to the packer sleeve 48. In order to limit relative movement between the collar 50 and sleeve 48, the sleeve 48 includes a groove 52 which receives a slide screw 54.

Referring still to FIGS. 3–5, disposed primarily longitudinally downhole of the packer assembly 42 is locking ratchet means 56 which selectively prevents movement of the outer sleeve assembly 26 relative to the mandrel 22 thereby locking the packer 16 in its set position. Extending beneath the packer and slip assemblies in sliding engagement with the mandrel 22 is a ratchet sleeve 58 having a ratchet surface 60 formed at the lower end thereof. Similarly, the mandrel 22 includes a ratchet surface 62 formed proximate the downhole end of the mandrel 22. Both ratchet surfaces 60 and 62 are helical in the form of threads to allow rotating disengagement and permit longitudinal movement in only one direction. A lower ratchet nut 64 is engageable with the ratchet surface 62 of the mandrel 22 while an upper ratchet nut 66 is engageable with the ratchet surface 60 of the ratchet sleeve 58. The ratchet nuts 64 and 66 are connected to each other by a mounting sleeve 68. The lower ratchet nut 64 is slidably secured to the mounting sleeve 68 by a torque screw 70 received within a longitudinal slot 72 of the sleeve 68. The upper ratchet nut 66 is releasably secured to the mounting sleeve 68 by a first shear screw 74. The ratchet means 56 is housed within a housing sleeve 76. The housing sleeve 76 is connected at its upper end to the lower packer collar 50 and secured by set screw 78 and at its lower end to an end sub 80 through threads 82. The housing sleeve 76 is also detachably connected to the mounting sleeve 68 by second shear screw 84. As tension is applied through the mandrel 22 to set the packer 16, the ratchet surface 62 of the mandrel 22 will move downwardly to engage the lower ratchet nut 64 thereby locking the mandrel 22 against release relative to the ratchet means 56 and the end sub 80. Furthermore, as the mandrel 22 travels downwardly, the key block 33 will abut ratchet sleeve 58 preventing its movement allowing the ratchet sleeve ratchet surface 60 to engage the upper ratchet nut 66 thereby locking the ratchet sleeve 58 against longitudinal movement relative to the upper ratchet nut 66. These ratchet surfaces 60 and 62 and the inner surfaces of the ratchet nuts 64 and 66 comprises angled cooperating teeth which allow them to pass over each other in a first direction but prevent movement in the opposite direction. The helical form of the ratchet surfaces 60 and 62 herein allow release by relative rotation of the cooperating components. The lower ratchet nut 64 engages the mandrel ratchet surface 62 as the packer 16 is run into the well bore to preset the packer 16 prior to setting at the desired location as will be subsequently described.

The end sub 80 includes a throughbore 86 which communicates with the axial bore 24 of the mandrel 22. Formed at the upper end of the axial bore 24 is a lateral port 88 which selectively communicates with a port 90 in the connector assembly 28. The ports and bores form a selectively closable fluid bypass passageway which facilitates pressure equalization as the packer 16 is run into the hole and prior to release and retrieval of the packer 16.

The connector assembly 28 includes a slide valve 92 mounted to the mandrel 22 and having spaced apart seals 94. The port 90 is preferably formed in the slide valve 92 and the seals 94 are spaced so as to seal off the lateral port 88 of the mandrel 22 as will be subsequently described. Extending upwardly from the slide valve 92 are a plurality of connecting fingers 96. The fingers 96 detachably connect the slide valve 92 to a release/tie back sleeve 98 and are received within a recess 100 formed in the release/tie back sleeve 98. The mandrel 22 includes a similar recess 102 to receive the fingers 96 when the slide valve 92 is drawn upwardly a predetermined distance to allow disconnection of the release/tie back sleeve 98 from the mandrel 22 and slide valve 92. The release/tie back sleeve 98 is connected to the mandrel 22 by a J-latch assembly 104. Additionally, the release/tie back sleeve 98 is detachably connected to the mandrel 22 by a tensile bolt 106 such that the sleeve 98 will release from the mandrel 22 only when a predetermined amount of tension is applied to shear the bolt 106 ensuring that the packer 16 is set. The release/tie back sleeve 98 is connected to the running string 20 by threaded engagement.

Operation of the present invention provides mechanical setting and release of the packer 16 including up to three alternative methods of unsetting the packer 16 as will be subsequently described. Prior to running into the well bore 14 (FIG. 3), the ratchet assembly 56 is disengaged and allowed to hang freely so long as the drag blocks 30 do not engage the casing wall 14. As the tool is run into the hole using the running tool 20 and controlled by the hydraulic extension system 18, the drag blocks 30 will engage the wall 14 placing a tension on the outer sleeve assembly 26. The frictional engagement of the drag blocks 20 against the wall 14 will cause the mandrel 22 to move downward faster than the outer sleeve assembly 26 and the ratchet sleeve 58 forcing the ratchet surface 62 of the mandrel 22 into engagement with the lower ratchet nut 64 pre-setting the packer 16. In this position, the key block 33 will abut the ratchet sleeve 58 as shown in FIG. 4 to prevent any additional movement of the ratchet sleeve 58 relative to the mandrel 22. At this point, any upward movement of the mandrel 22 will cause the packer 16 to set in the well bore 14 (FIG. 4) although the packer 16 can be run downhole any necessary depth.

Figure 6:
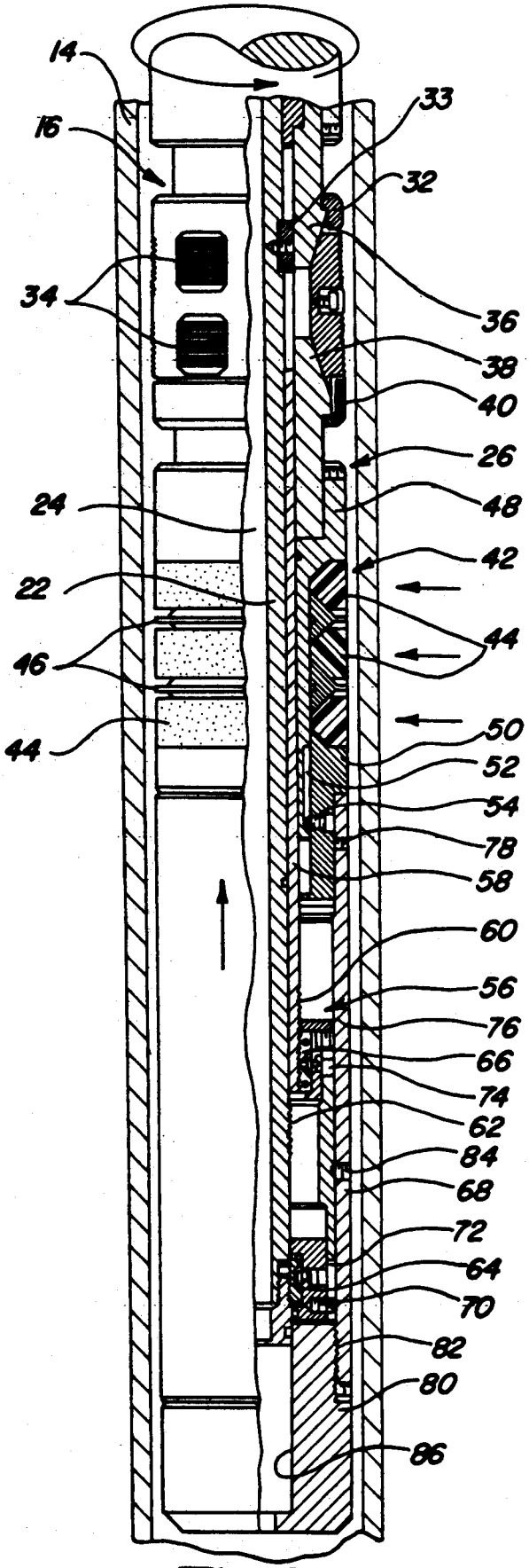
FIG. 6 is a partial cross-sectional view of the released packet unset by a first method.

Once the packer 16 is positioned a sufficient depth within the well bore 14, the packer 16 can be set by applying upward tension on the mandrel 22 through the running string 20. Since the mandrel 22 is now connected to the outer sleeve assembly 26 through the lower ratchet nut 64 upward tension on the mandrel 22 will draw the outer sleeve assembly 26 against the frictional engagement of the drag blocks 30. As upward tension is applied, the force will be conducted through the lower ratchet nut 64, the mounting sleeve 68, and housing sleeve 76 against the lower collar 50 causing initial compression of the packing elements 44 against the packing sleeve 48. Continued tension will cause lower slip cone 38 to move towards upper slip cone 36 forcing the slip elements 34 outwardly into engagement with the casing wall 14. With the slip assembly 32 set, continued tension will cause full compression of the packing elements 44 into sealing engagement with the wall 14 as shown in FIG. 5. The tension will also be transferred from the lower ratchet nut 64 through the mounting sleeve 68 to the upper ratchet nut 66. Since the ratchet sleeve 58 engages the key block 33 at its upper end continued tension will cause the upper ratchet nut 66 to travel along the ratchet surface of the ratchet sleeve 58. Although this movement will be minimal it ensures secure setting of the packer 16 by preventing release between the mandrel 22 and ratchet sleeve 58 and the upper ratchet nut 66. Moreover, since the mounting sleeve 68 is tied to the outer sleeve 26 by shear screw 84 shearing of the screw 84 allows the packing elements 44 to relax relative to the mandrel 22, ratchet sleeve 58 and ratchet means 56. Thus, the ratchet means 56 shifts between an unset position prior to being run into the well bore (FIG. 3), a preset position as the packer 16 is run into the well (FIG. 4), a set position (FIG. 5) and either of the release modes (FIGS. 6 and 7).

With the packer 16 set within the well bore 14, additional upward tension will cause the tensile bolt 106 to break allowing the release/tie back sleeve 98 to separate from the mandrel 22. As this occurs, the upward movement of the sleeve 98 will draw the slide valve 92 upwardly until fingers 96 seat within the recess 102 of the mandrel 22. The upward movement of the slide valve 92 will have closed the lateral port 88 of the mandrel 22 by positioning the seals 94 an opposite side thereof closing the bypass passageway. The release/tie back sleeve 98 can now be disconnected from the packer 16 by disconnecting the J-latch 104 and the running string 20 and sleeve 98 removed from the well bore 14 to permit work on the wellhead 12.

Once repairs have been completed, the release/tie back sleeve 98 is run into the hole on the string 20 into engagement with the packer 16. As the release/tie back sleeve 98 re-engages, the slide valve 92 will be forced downwardly to align the ports 88 and 90 equalizing the pressure above and below the packer 16. With the running string 20 reattached the packer 16 can now be mechanically unset and retrieved. The preferred method of unsetting is to rotate the running string 20 and mandrel 22 relative to the outer sleeve assembly 26. This will cause the thread-like ratchets 62 of the mandrel 22 and the lower ratchet nut 64 to threadably disconnect releasing the sleeve assembly 26. Upon release the packer 16 will return to its unset position shown in FIG. 3 releasing the packer assembly 42 and the slip assembly 32 from engagement with the well bore 14. Since the ratchet surfaces have not been preset through downward movement, the packer 16 can be retrieved without resetting.

Figure 7:
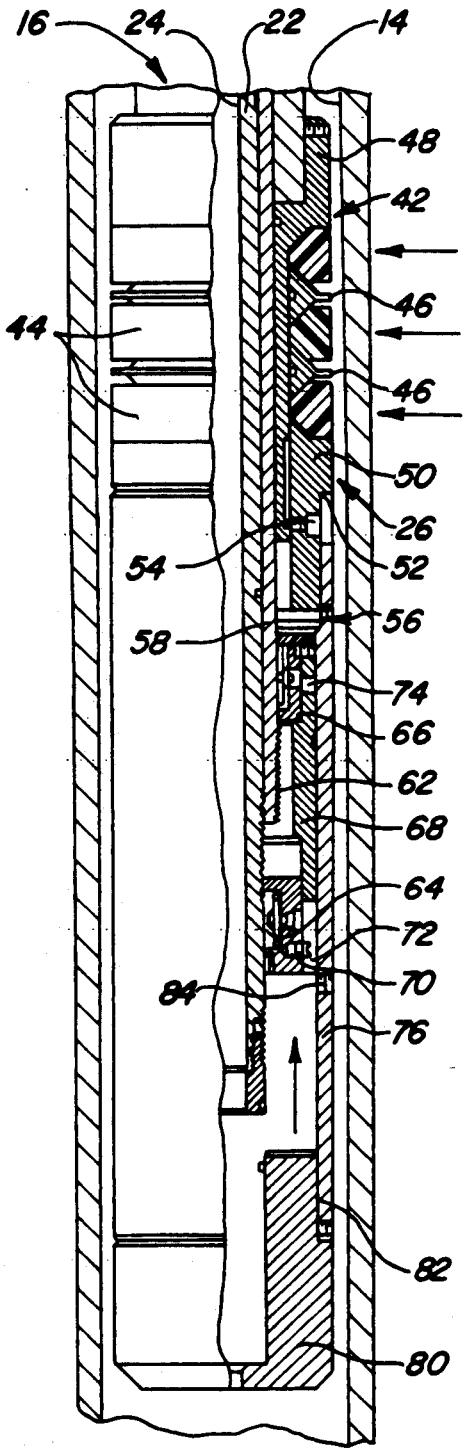
FIG. 7 is a partial cross-sectional view of the packer unset by a second method.

Since release of the packer 16 occurs when the mandrel 22 is released from the outer sleeve assembly 26, the packer 16 can be unset by applying additional upward tension on the mandrel 22 until the second screw 84 shears freeing the housing sleeve 76, which is secured to the outer sleeve assembly 26, from the ratchet mechanism 56 and the mandrel 22 as shown in FIG. 7. A still further alternative combines shear force with threaded disengagement. Sufficient force is applied to shear screw 74 of the upper ratchet nut 66 and thereafter the upper ratchet nut is threadably disconnected from the ratchet surface 60 of the sleeve 58 releasing the packer 16.

Thus, the present invention provides a mechanically set and unset packer 16 for use in a wellhead repair unit which ensures sealing pack-off of the well while also allowing for simple retrieval of the packer 16.

The foregoing detailed description has been given for clearness of understanding only and no unnecessary limitations should be understood therefrom as some modifications will be obvious to those skilled in the art without departing from the scope and spirit of the appended claims.

I claim:

1. A well packer mechanically settable and retrievable within a well bore using a running tool to selectively isolate the wellhead, said packer comprising:

an inner mandrel;

a sleeve assembly movably mounted to said inner mandrel, said sleeve assembly selectively adjustable along said mandrel for longitudinal movement of said mandrel in a first direction relative to said sleeve assembly to set said packer; and locking ratchet means for selectively preventing longitudinal movement of said mandrel in a second direction relative to said sleeve assembly thereby preventing release of said packer, said locking ratchet means including a first ratchet nut movable to a preset position as said packer is run into the well bore and a second ratchet nut said ratchet means being selectively disengageable to allow longitudinal movement of said mandrel in said second direction relative to said sleeve assembly to unset said packer for retrieval thereof;

said sleeve assembly including at least one packing element selectively compressible into sealing engagement with the well bore and at least one slip selectively engageable with the well bore to set said packer within the well bore.

2. The packer as defined in claim 1 and further comprising a release/tie back sleeve detachably connected to an upper end of said mandrel by latching means, said release/tie back sleeve attached to the running tool and selectively detachable from said mandrel whereby tension on the running tool will be transmitted to said mandrel to set said packer and said release/tie back sleeve is reconnectably detachable from said mandrel to leave said set packer within the well bore.

3. The packer as defined in claim 2 wherein said locking ratchet means includes a ratchet surface formed on said inner mandrel and said first ratchet nut disengagably connected to said sleeve assembly, said ratchet surface and said ratchet nut having cooperating helical ratchet surfaces which permit longitudinal movement in said first direction while preventing longitudinal movement in said second direction, said ratchet surfaces engaging as said packer is run into the well bore to preset said packer, said ratchet surfaces cooperating to facilitate setting of said packer upon application of upward tension on said mandrel.

4. The packer as defined in claim 3 wherein said ratchet sleeve and first ratchet nut are threadably disengageable whereby said locking ratchet means may be rotatably released to allow longitudinal movement of said sleeve assembly in said second direction relative to said mandrel to unset said packer for retrieval.

5. The packer as defined in claim 3 wherein said ratchet means is detachably connected to said sleeve assembly whereby said sleeve assembly may be disconnected from said ratchet means to unset said packer for retrieval.

6. The packer as defined in claim 2 wherein said mandrel includes a partial axial passageway in fluid communication with an equalizing port.

7. The packer as defined in claim 6 wherein said release/tie back sleeve includes a lateral port selectively alignable with said equalizing port of said mandrel to provide fluid pressure equalization above and below said packer.

8. The packer as defined in claim 7 wherein said release/tie back sleeve is selectively connected to said mandrel by a J-slot assembly.

9. The packer as defined in claim 1 wherein said sleeve assembly includes at least one drag block to facilitate setting of said at least one packing element and said at least one slip.

10. A well packer settable and retrievable within a well bore using a running tool to selectively isolate the wellhead of a well for removal of the wellhead valve, said packer comprising:

an inner mandrel;

a release/tie back sleeve detachably connected to an upper end of said mandrel, the running tool secured to said sleeve for running and retrieving said packer from the well bore;

a sleeve assembly movably mounted to said inner mandrel, said sleeve assembly including at least one packing element selectively compressible into sealing engagement with the well bore and at least one slip selectively engageable with the well bore, said sleeve assembly selectively adjustable along said mandrel for longitudinal movement of said mandrel in a first direction relative to said sleeve assembly to set said at least one packing element and said at least one slip; and locking ratchet means to selectively prevent longitudinal movement of said mandrel in a second direction relative to said sleeve assembly unsetting said packer, said ratchet means including a first ratchet nut moving from a release position to a preset position as said packer is run into the well bore to facilitate setting of said packer and a second ratchet nut to facilitate selective release of said ratchet means to allow longitudinal movement of said mandrel in said second direction relative to said sleeve assembly to unset said at least one packing element and said at least one slip for retrieval of said packer;

said release/tie back sleeve detachable from said mandrel to leave said set packer within the well bore and reconnectable to said mandrel to unset and retrieve said packer.

11. The packer as defined in claim 10 wherein said sleeve assembly includes at least one drag block engageable with the well bore to facilitate setting of said at least one packer element and said at least one slip.

12. The packer as defined in claim 10 wherein said locking ratchet means includes a ratchet surface formed on said inner mandrel and said first ratchet nut connected to said sleeve assembly, said ratchet surface and said first ratchet nut having cooperating ratchet surfaces which permit relative longitudinal movement in said first direction to set said packer while preventing relative longitudinal movement in said second direction to release said packer, said first ratchet nut engaging said ratchet surface as said packer is run into the well bore to preset said packer such that upward tension applied to said mandrel will set said packer within the well bore.

13. The packer as defined in claim 12 wherein said ratchet nut includes shear means for releasing said ratchet nut from said sleeve assembly such that said mandrel and ratchet nut may move longitudinally in said second direction relative to said sleeve assembly to release said packer for retrieval from the well bore.

14. The packer as defined in claim 12 wherein said ratchet nut threadably engages said ratchet surface such that said locking ratchet means may be rotatably released to allow longitudinal movement of said mandrel in said second direction relative to said sleeve assembly to unset said packer.

15. The packer as defined in claim 10 wherein said inner mandrel includes a partial axial bore open to the bottom of said packer and a selectively closable lateral port formed through said mandrel to provide selective fluid communication between said partial axial bore and the well bore above said sleeve assembly, said lateral port and partial axial bore forming a selectively openable equalizing fluid passageway.

16. A well packer mechanically settable and retrievable within a well bore using a running tool to selectively isolate the wellhead, said packer comprising:

an inner mandrel;

an outer sleeve assembly mounted to said inner mandrel, said outer sleeve assembly including slip means and packing means selectively engageable with the well bore upon movement of said mandrel in a first direction relative to said sleeve assembly to set said packer;

locking ratchet means to selectively prevent longitudinal movement of said mandrel, said outer sleeve assembly including slip means and packing means selectively engageable with the well bore upon movement of said mandrel in a first direction relative to said sleeve assembly to set said packer, locking ratchet means to selectively prevent longitudinal movement of said mandrel in a second direction relative to said outer sleeve assembly to unset said packer, said ratchet means being selectively disengageable to allow longitudinal movement of said mandrel in said second direction relative to said outer sleeve assembly to unset said packer for retrieval, said ratchet means including a first ratchet nut and a second ratchet nut connected to said outer sleeve assembly, said first ratchet nut selectively engageable with a ratchet surface formed on said mandrel and said second ratchet nut selectively cooperating with a ratchet sleeve slidably mounted to said mandrel;

said first ratchet nut cooperating with said ratchet surface as said packer is run into the well bore to preset said packer such that upward tension applied to said mandrel will set said slip means and packing means of said outer sleeve assembly and said second ratchet nut adjustably engaging said ratchet sleeve to facilitate release of said ratchet means for retrieval of said packer; and a release/tie back sleeve detachably connected to an upper end of said mandrel, the running tool secured to said release/tie back sleeve for running and retrieving said packer from the well bore, said release/tie back sleeve detachably connected to said mandrel by a J-slot assembly.

17. The packer as defined in claim 16 wherein said mandrel includes a partial axial bore open to the bottom of said packer and a selectively closable lateral port formed in said mandrel to provide selective fluid communication between said partial axial bore and the well bore above said packer, said lateral port closable and openable upon detachment and attachment of said release/tie back sleeve respectively.

18. The packer as defined in claim 16 wherein said ratchet nut includes shear means for releasably connecting said ratchet nut to said outer sleeve assembly such that said mandrel and ratchet nut may move longitudinally in said second direction relative to said sleeve assembly to release said packer for retrieval from the well bore.

19. The packer as defined in claim 16 wherein said ratchet nut threadably disengages said ratchet surface such that said ratchet locking means may be rotatably released by rotating said mandrel and ratchet surface relative to said ratchet nut and outer sleeve assembly to allow longitudinal movement of said mandrel in said second direction relative to said sleeve assembly to release said packer for retrieval from the well bore.

20. The packer as defined in claim 16 wherein said outer sleeve assembly includes at least one drag block engageable with the well bore to facilitate setting of said slip means and packing means.

21. The packer as defined in claim 16 and further comprising a shear bolt connecting said release/tie back sleeve to said upper end of said mandrel, said bolt shearing prior to disconnection of said J-slot assembly.

22. A packer mechanically settable and retrievable within a well bore using a running tool to selectively isolate a section of the well bore, said packer comprising:

an inner mandrel;

a sleeve assembly having packing means mounted to said inner mandrel, said sleeve assembly selectively adjustable along said mandrel for longitudinal movement of said mandrel in a first direction relative to said sleeve assembly to set said packer; and locking ratchet means for selectively preventing longitudinal movement of said mandrel in a second direction relative to said sleeve assembly thereby preventing release of said packer, said locking ratchet means including a first ratchet nut and a second ratchet nut connected to said sleeve assembly and a ratchet surface formed on said mandrel;

said locking ratchet means selectively movable between a released position wherein said first ratchet nut is disengaged from said ratchet surface and a preset position wherein said first ratchet nut engages said ratchet surface of said mandrel as said packer is run into the well bore such that subsequent upward tension on said mandrel will set said packing means preventing longitudinal movement of said mandrel in said second direction to prevent release of said packer, said second ratchet nut adjustably engaging a ratchet sleeve slidably mounted to said mandrel to facilitate release of said ratchet means for retrieval of said packer.

23. The packer as defined in claim 22 wherein said first ratchet nut threadably disengages said ratchet surface such that said locking ratchet means may be rotatably released by rotating said mandrel and ratchet surface relative to said ratchet nut and sleeve assembly thereby allowing longitudinal movement of said mandrel in said second direction relative to said sleeve assembly to release said packer for retrieval from the well bore.

24. The packer as defined in claim 22 wherein said ratchet means includes shear means for releasably connecting said ratchet nut to said sleeve assembly such that said mandrel and ratchet nut may move longitudinally in said second direction relative to said sleeve assembly to release said packer for retrieval from the well bore.

* * * * *

UNITED STATES PATENT AND TRADEMARK OFFICE

CERTIFICATE OF CORRECTION

PATENT NO. : 5,009,265

DATED : April 23, 1991

INVENTOR(S) : THOMAS F. BAILEY et al

It is certified that error appears in the above—identified patent and that said Letters Patent is hereby corrected as shown below:

ON TITLE PAGE: Item [75]

The name of the listed inventor

"Richard Lee"

is corrected to

--Richard L. Palmer--

Signed and Sealed this

First Day of September, 1992

*Attest:*

DOUGLAS B. COMER

*Attesting Officer*

*Acting Commissioner of Patents and Trademarks*